US010881229B2

(12) United States Patent
Ogden

(10) Patent No.: US 10,881,229 B2
(45) Date of Patent: Jan. 5, 2021

(54) CAKE PROTECTION UNIT

(71) Applicant: Michael Ogden, Dunmore, PA (US)

(72) Inventor: Michael Ogden, Dunmore, PA (US)

( * ) Notice: Subject to any disclaimer, the term of this patent is extended or adjusted under 35 U.S.C. 154(b) by 0 days.

(21) Appl. No.: 15/217,997

(22) Filed: Jul. 23, 2016

(65) Prior Publication Data

US 2016/0331164 A1 Nov. 17, 2016

(51) Int. Cl.
*A47G 19/26* (2006.01)
*B65D 85/36* (2006.01)

(52) U.S. Cl.
CPC ..... *A47G 19/26* (2013.01); *B65D 85/36* (2013.01); *B65D 2585/363* (2013.01)

(58) Field of Classification Search
CPC ..... A47G 19/26; A47G 23/00; B65D 5/42; B65D 5/4204; B65D 5/50; B65D 5/502; B65D 25/04; B65D 59/00; B65D 77/02; B65D 85/36; B65D 85/72; B65D 2585/365; F16M 13/02
USPC ..... 206/551, 557–565; 99/422–425; 426/124
See application file for complete search history.

(56) References Cited

U.S. PATENT DOCUMENTS 1,944,305 A * 1/1934 Schmidt ..... B65D 5/5028 206/784
2,452,629 A * 11/1948 Bonekamp ..... B65D 85/36 426/124
2,879,886 A * 3/1959 Crane ..... B65D 85/34 206/560
7,857,136 B2 * 12/2010 Sielski ..... B65D 5/20 206/561
9,545,167 B2 * 1/2017 Honeycutt ..... A47G 19/30
10,463,181 B2 * 11/2019 Kaupp ..... A47G 19/26

* cited by examiner

*Primary Examiner* — Bryon P Gehman
(74) *Attorney, Agent, or Firm* — Paul R. Martin

(57) ABSTRACT

An arched support strut dement that fits on top of a cake pan and which extends over the cake. The support strut element is located above the top rim of the pan and extends over the cake to support a flexible element, such as Saran@ Wrap, or the like, above the top surface of the cake. More specifically, the struts are adjustable so they can accommodate any width of pan and the hooks on the ends are memory-flexible so they can be bent to accommodate any edge shape for a pan.

3 Claims, 1 Drawing Sheet

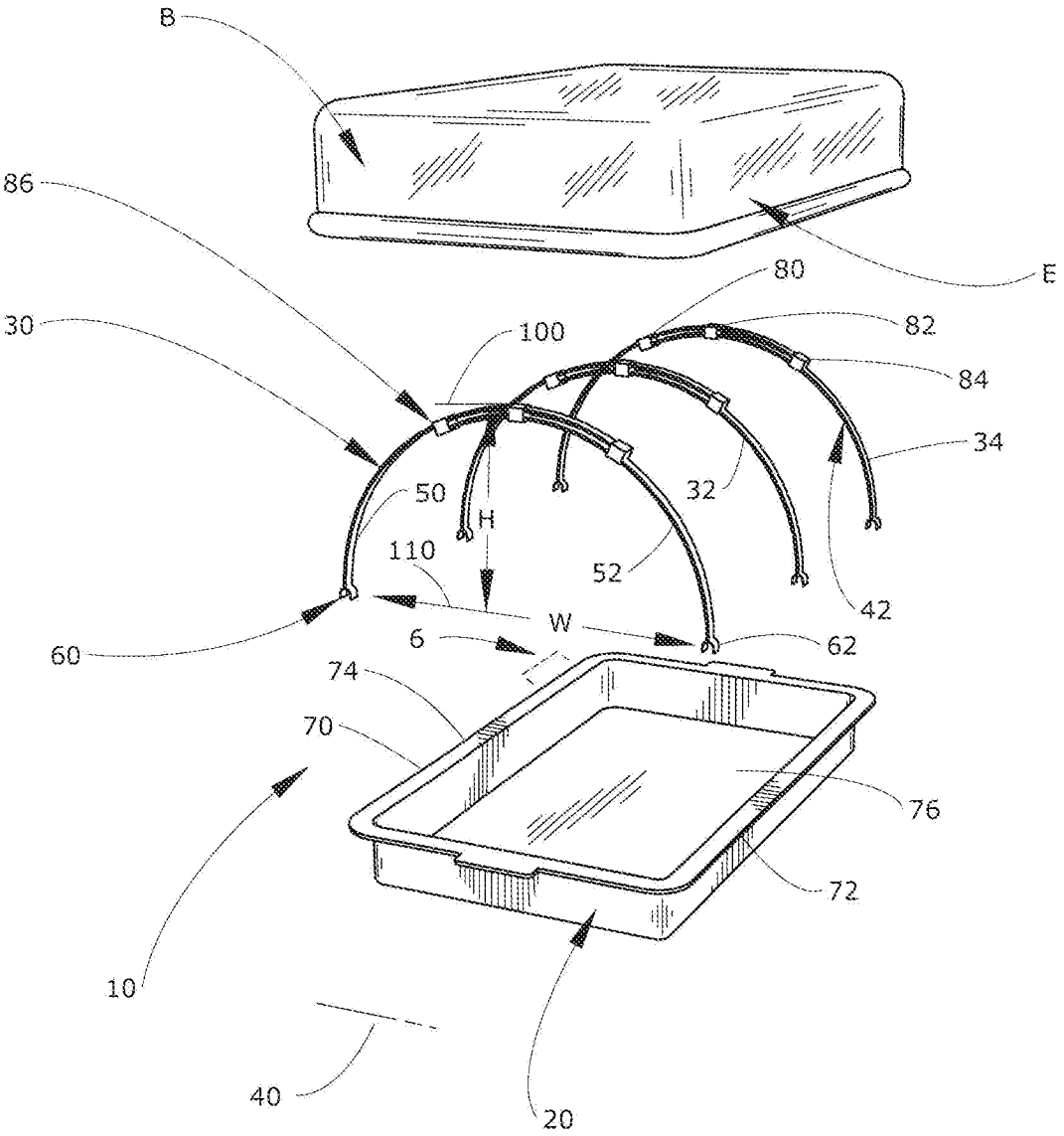
E
B
86
30
80
82
84
34
100
42
32
52
50
H
110
60
W
6
62
76
72
74
70
10
20
40

CAKE PROTECTION UNIT

TECHNICAL FIELD OF THE INVENTION

The present invention relates to the general art of baking, and to the particular field of accessories used in baking.

BACKGROUND OF THE INVENTION

A freshly baked cake just out of the oven is a source of pleasure in any home.

When a cake is baked, if it rises above the rim of the pan, any lid associated with that pan becomes useless. When a lid cannot be used, people usually place a flexible material, such as Saran wrap over the top surface of the cake to protect it. However, Saran wrap will stick to icing on the top surface; therefore toothpicks are stuck into the cake to keep it from sticking to the cake and possibly damaging the icing. This becomes more trouble than it is worth because the toothpicks generally do not provide enough support to prevent the SARAN@ wrap from falling on top of the icing, thus ruining the cake.

Therefore, an object of this invention is to provide a means for protecting a cake so that the cake or any frosting on the cake will not be contacted by flexible wrap used to cover the cake. Therefore, an object of this invention is to provide a means to protect a cake so frosting on the cake will not be contacted by flexible wrap used to cover the cake.

Various holders have heretofore been used for holding cakes. For example, U.S. Pat. No. 3,690,902 issued to Dahl on Sep. 12, 1972, discloses a cake package having a base and a hollow cake cover. The base is a piece of cardboard and the cover has flanges projecting out from an outer periphery of the cover such that the flanges may be stapled to the base.

Other cake holders have included a cake holder having a relatively thick plastic translucent cover and a relatively thick plastic colored base. At the outer periphery of the base a pair of opposite handles extend radially outwardly. Each of the handles has an upper concave surface. The cover includes a pair of radially outwardly projecting flanges extending past the outer periphery of the cover to enable one to lift the cover off of the base. An upwardly projecting rim is disposed around a cake support surface of the base and mates to a corresponding circumferential groove on the underside of the cover.

Although various previous cake holders have been generally useful, they have often been subject to one or more of several disadvantages. For example, the cake holder may not include a convenient and reusable arrangement for attaching the cover to the base. Some prior cake holders are made of expensive material such that they may not be suitable for a bakery to use as a package to supply a cake to a customer.

Bakeries have been seeking improved packaging for their fragile, icing covered items such as cakes and pastries. The essential requirement of such packaging is, of course, that it be economical, that the bakery item can be readily assembled in the package, that the bakery item is clearly displayed, yet protected while in the package, and that the package may be repeatedly opened and reclosed by the consumer to preserve the protection of the bakery item while the item is being consumed in the home.

Most housewives are familiar with the well known "Tupperware" brand of plastic containers, including a cake container embodying relatively heavy plastic base having an elevated rim portion and a dome-shaped cover having grooves mounted in the bottom periphery of the cover sidewalls which effect a snap engagement with the upstanding peripheral edges of the base. The characteristics of a container of this general type, particularly if it were to be made from a clear transparent plastic, would be ideal for the marketing of bakery products, but unfortunately, as is well known to those skilled in the art, the cost of this type of reusable container is far in excess of that permissible for a marketing package, the life of which is generally not in excess of two weeks, from the time that a bakery item is first placed in the package, through its shelf life in the store and through its normal life in the home until the bakery item packaged therein has been consumed.

Attempts have been made in the past to employ open top paperboard boxes for pastry items and then close the open upper portion of the box with a clear plastic sheet wrapped around the box. This method of packaging is distinctly undesirable in that the plastic sheet invariably contacts the icing in the course of handling the package and removes a portion of same whenever the plastic sheet is removed to provide access to the bakery item. Moreover, once the plastic sheet is opened the package is essentially destroyed and cannot be used to protect the unconsumed portion of the bakery item.

There is a definite need, therefore, for a package for bakery items which is economical, and is readily openable and re-closable by the consumer to permit access to the bakery item and to provide protection for any unconsumed portions of the bakery item.

The inventor is aware of packages for cakes such as disclosed in U.S. Pat. No. 4,425,356 to Dakl have a base and a domed plastic cover secured to the base by sticky tabs on the cover being placed in overlying contact with complementary tabs on the base. Such packages have the disadvantage of failing to provide secure coupling of the plastic cover to the base under varying conditions to which the package may be subjected. For example, the reusable adhesive between tabs on the base and cover may become inoperative due to cold temperatures or excessive heat. The adhesion between tabs may not be strong enough to withstand forces to which the packaging may be subjected. In use of known adhesive packages, if the cake, its icing or other substances such as flour come into contact with the adhesive on the tabs, the tabs will foul and not hold the cover on the base. In manufacture, such known adhesive packages suffer the disadvantage that application of the re-usable adhesive is difficult, expensive and limits the nature of materials which can be used for the base.

Containers are often used to store baked goods after cooking or purchase to preserve and/or transport the items. Typical baked goods containers often come in various sizes, include both circular and rectangular shapes, and include a single support surface and interior.

Oftentimes, however, a consumer purchases or bakes a number of different items or varying sizes and shapes and finding the correct storage container can sometimes be difficult. For example, a consumer may purchase or bake a relatively large item such as a pie, along with a number of smaller items, such as muffins. In this scenario, the typical consumer would need a number of containers to store the goods, including one for the pie, and at least one for the muffins.

Additionally, if the consumer purchased or baked a cake instead, the consumer would typically need another larger container to store that item as well. This may lead to some frustration on the part of the consumer as finding the right container to store a variety of goods may require a number of separate purchases of storage containers.

With the differing sizes of the containers that may be required to store various goods, a consumer may find it difficult to store the containers in a limited space. For example, a typical cake container is usually a very large product that is difficult to store and takes up a great deal of space in a storage cabinet. Additionally, the cake container purchased may not nest with and/or cooperate with a separately purchased cupcake holder, thereby increasing the amount of storage necessary. Thus, for a variety of reasons, consumers may find it sometimes difficult to justify the purchase of a cake keeper that will only have a limited usage (e.g., used only when one bakes or buys a cake), as well as a rigid storage interior (e.g. not flexible to store multiple products of varying sizes.)

Therefore, another object of the present invention is to improve the design of these containers so that there is versatility.

SUMMARY OF THE INVENTION

The above-discussed disadvantages of the prior art are overcome by an arched support strut element that fits on top of a cake pan and which extends over the cake. The support strut element is located above the top rim of the pan and extends over the cake to support a flexible element, such as Saran@ Wrap, or the like, above the top surface of the cake. More specifically, the struts are adjustable so they can accommodate any width of pan and the hooks on the ends are memory-flexible so they can be bent to accommodate any edge shape for a pan.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURE

The invention can be better understood with reference to the following drawing and description. The components in the FIGURE are not necessarily to scale, emphasis instead being placed upon illustrating the principles of the invention. Moreover, in the FIGURE, like referenced numerals designate corresponding parts throughout the different views.

FIG. 1 is an exploded perspective view of a cake protection unit embodying the present invention.

DETAILED DESCRIPTION OF THE INVENTION

Referring to the FIGURE, it can be understood that the present invention is embodied in a unit 10 which is used to prevent flexible covering, such as a bag B or flexible wrap, such as Saran@ Wrap or the like, from contacting a cake during storage or transport.

Unit 10 is used in conjunction with a pan 20 in which the cake is located and prevents contact between that cake and bag B. Unit 10 includes a plurality of arcuate support ribs 30, 32 and 34 which extend along transverse axis 40 of pan 20, Each rib includes an arcuate body, such as body 42 of rib 34, two slidably connected sections, such as sections 50 and 52 of rib 30, and two arcuate end clips, such as end clips 60 and 62 of rib 30, that are bendable and which are sized to snugly engage side walls 70 and 72 of pan 20 adjacent to the top rims 74 and 76 respectively thereof to securely mount the associated rib in the side walls of the pan.

Each rib further includes a plurality of slider blocks, such as slider blocks 80, 82 and 84 of rib 34, and 86 on rib 30 which slidably connect the two sections of the rib together. The slidable connection between the two sections of each rib permit the width W of the rib, as measured between the end clips thereof, and the height H thereof as measured between a line tangent to the topmost location of the rib, indicated by plane 100 tangent line to the top of rib 30, and a plane P containing the two end clips as indicated by plane 110 associated with rib 30, to be adjusted to fit pan 20 and have the tangent line located spaced above a cake being accommodated in the pan. This will protect the top of the cake from contact with any material used to cover the cake, such as bag B.

Conventional baking pans are available generally in a range of common sizes, for example and 11"×13", Because they are adjustable, the ribs of unit 10 can be used on any size baking pan. The slider blocks permit the riles to have their width adjusted so the end clips will securely mount the ribs on the side walls of the pan and the height of the ribs can be adjusted to space the ribs, and hence the flexible covering, above a cake, indicated in the FIGURE by a dotted line C, and thus prevent the flexible covering from contacting the cake.

As is also shown in the FIGURE, an elastic band E can be used to secure bag B to the ribs and hence secure bag B in a cake covering position.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A unit for protecting a cake comprising:

A) a supporting pan having a first side wall, a second side wall, a transverse axis extending between the first side wall and the second side wall, a first top rim on the first side wall, a second top rim on the second side wall, and a width dimension as measured along the transverse axis between the first side wall and the second sidewall; and B) a plurality of support ribs, each support rib including an arcuate body, the arcuate body of each support rib including a first section having a first end, and a second section having a second end, a first end clip on the first end of the first section of each support rib, a second end clip on the second end of the second section of each support rib, the first end clip and the second end clip of each support rib being flexible and adapted to snugly engage the top rims of the supporting pan side walls to securely mount each support rib on the supporting pan, each support rib further including a width dimension as measured between the first end clip and the second end clip, and a height dimension as measured between a plane containing the first and second end clips and a plane tangent to a highest point on the support rib, and a plurality of slider blocks slidably connecting the first and second sections of each support rib together so the first section and the second section of each support rib can slide with respect to each other so the width of each support rib can be adjusted to match the width dimension of the supporting pan so each support rib will span the width of the supporting pan when securely mounted on the side walls of the supporting pan and the height of each support rib can be adjusted so each support rib will extend above a cake located in the supporting pan beneath the rib.

2. The unit defined in claim 1 further including a flexible band secured to the support ribs.

3. A unit for protecting a cake comprising: a baking pan having two side walls and a width dimension measured between the side walls; and a cover unit having at least one rib, each rib includes a first rib section and a second rib section that are movably connected together, each of the first and second rib sections having a first end and a second end, the first end of the first rib section being located adjacent to a first end of the second rib section and the second end of the first rib section being spaced apart from the first end of the first rib section and spaced apart from the second end of the second rib section, the at least one rib further including a respective clip on each second end of the first and second rib sections, for attaching to the side walls of the baking pan to mount the cover unit on the baking pan, each rib having a width dimension measured between the clips on the second ends of the first and second rib sections, and at least one slider block slidably connecting the respective first and second rib sections together so the respective first and second rib sections can move relative to each other and move the clips on the rib sections toward and away from each other to adjust the width dimension of the at least one rib to match the width dimension of the baking pan.

* * * * *